United States Patent [19]

Länge

[11] Patent Number: 4,782,961

[45] Date of Patent: Nov. 8, 1988

[54] CRANE

[75] Inventor: Walter Länge, Ludesch, Austria

[73] Assignee: Liebherr-Werk Nenzing G.m.b.H., Nenzing, Austria

[21] Appl. No.: 16,411

[22] Filed: Feb. 19, 1987

[30] Foreign Application Priority Data

Feb. 19, 1986 [DE] Fed. Rep. of Germany ..... 3605324

[51] Int. Cl.[4] ..... B66C 23/53

[52] U.S. Cl. ..... 212/191; 212/159; 254/900

[58] Field of Search ..... 212/191, 159, 160, 161, 212/173; 254/274, 277, 900

[56] References Cited

U.S. PATENT DOCUMENTS

| | | | |
|---|---|---|---|
| 3,799,505 | 3/1974 | Duncan | 254/274 |
| 3,946,559 | 3/1976 | Stevenson | 254/900 |
| 3,957,161 | 5/1976 | Tax | 212/173 |
| 4,025,055 | 5/1977 | Strolenberg | 212/191 |
| 4,180,171 | 12/1979 | Cunningham et al. | 212/191 |
| 4,304,337 | 12/1981 | Dummer | 212/191 |

FOREIGN PATENT DOCUMENTS

| | | | |
|---|---|---|---|
| 8403587 | 6/1986 | Netherlands | 212/191 |

*Primary Examiner*—Sherman D. Basinger
*Assistant Examiner*—Thomas J. Brahan
*Attorney, Agent, or Firm*—Fleit, Jacobson, Cohn & Price

[57] ABSTRACT

A crane is provided which comprises a hoisting mechanism, which comprises a hoisting rope and a hoisting rope winch. A winch drive for the hoisting rope or a torque-limiting coupling connected between said winch drive and said winch is so controlled that in a period of time which preferably exceeds one second to the rope-pulling force exerted on the hoisting rope is increased in steps or continuously to a value which corresponds to the weight of the load or is sufficient to hoist the load, and that the winch is adapted to be rotated in a payout sense by opposing forces which tend to pull the hoisting rope from the winch and which exceed the instantaneous rope-pulling force.

11 Claims, 3 Drawing Sheets

CRANE

BACKGROUND OF THE INVENTION

1. Field of the Invention

This invention relates to a crane comprising a hoisting mechanism, which comprises a hoisting rope and a hoisting rope winch.

2. Description of the Prior Art

When a crane is used to hoist a load, special problems will arise when the load to be lifted from a support performs vertical movements relative to the crane. For instance, when a crane which is fixedly mounted on a drilling platform is used to hoist loads from a ship, said loads will perform vertical movements in unison with the ship relative to the crane on the platform. Said vertical movements will be due to the rolling and pitching performed by the ship in dependence on the amplitudes and periods of the waves. Depending on the wind and other weather conditions, said movements may be of considerable magnitude. When loads are being hoisted from a ship performing such movements, the latter will exert considerable dynamic stress shocks on the hoisting rope and via the hoisting rope on the crane structure. Said stress shocks are taken into account by the shock allowance factor Cb, which can be calculated by the following equation:

$$Cb=1+0.9\times(vh+vw)\times(K/(g\times L))^{\frac{1}{2}}$$

wherein

Cb=shock allowance factor, i.e., the factor by which the magnitude of the nominal load is to be multiplied for the calculation and design of the crane vh=velocity of crane hook vw=design vertical velocity of the load-carrying deck of a supply ship K=spring constant of the crane related to the vertical displacement of the load hook g=gravitational constant L=force action of the payload It is apparent that the shock allowance factor depends on the hoisting velocity, the stiffness of the crane and the vertical velocity of the load to be hoisted relative to the crane and takes the dynamic stresses into account which are exerted on the crane by the shock action of the load moving relative to the crane. In dependence on the significant height of the waves and the mean period of the waves that shock allowance factor may lie between 1.3 and about 4.5. Because a crane for hoisting moving loads must be designed for the largest shock allowance factor which may be required, the expenditure involved in the crane structure is greatly increased by the shock allowance factor.

SUMMARY OF THE INVENTION

For this reason it is an object of the invention to provide a crane which is of the kind described first hereinbefore and in which a shock allowance factor need not be taken into account in spite of considerable vertical movements between the crane and the load to be hoisted, such as are performed, e.g., by loads lying on ships being moved by the waves, so that the crane can be substantially designed for the case in which the load is lifted from a platform which is stationary relative to the crane although the load actually oscillates in a vertical direction.

In a crane which is of the kind described first hereinbefore that object is accomplished in that a winch drive for the hoisting rope winch or a torque-limiting coupling connected between said winch drive and said winch is so controlled that in a period of time which preferably exceeds one second the rope-pulling force exerted on the hoisting rope is increased in steps or continuously to a value which corresponds to the weight of the load or is sufficient to hoist the load, and that the winch is adapted to be rotated in a payout sense by opposing forces which tend to pull the hoisting rope from the winch and which exceed the instantaneous rope-pulling force.

By means of the crane in accordance with the invention, a load which is vertically moved relative to the crane can be lifted from its support substantially like a load which is initially stationary relative to the crane. When the initially slack rope is connected to the load by means of the crane hook or the like, the rope will initially become taut and will then be subjected to a progressively increasing part of the weight of the load. Nevertheless the load performs movements relative to the crane while the hoisting force exerted by the hoisting rope on the load progressively increases. As a result, the hoisting rope connected to the load is moving in unison with the load because the movements of the load relative to the crane are taken up by a forward and reverse rotation of the winch drum, which is driven with a predetermined torque. It is apparent that the crane in accordance with the invention can be used to lift a moving load from its support substantially like a stationary load.

Different from a stationary load, a vertically moving load is subjected to accelerations which are positive and negative in alternation in dependence on the direction of movement of the load. As a result, the rope-pulling force which in the crane in accordance with the invention is increased within a predetermined period of time will reach a value which corresponds to the weight of the load to be hoisted. This may result in a temporary increase of the force required to hoist the load when the latter is subject to a negative acceleration.

It is apparent that the crane in accordance with the invention will effect a shockless lifting of the load from its support at the time when the pulling force exerted on the rope has been increased to a value which corresponds to the force which is due to the weight of the load plus the instantaneously acting accelerating force.

In the design of the crane in accordance with the invention it is not necessary to take a shock allowance factor into account because the rope connected to the load will not be slack at the time at which the load is to be lifted from its support so that such rope cannot be subjected to shock forces by movements of such load.

In the design of the crane in accordance with the invention it is sufficient to take a safety factor into account but that safety factor may amount to a fractional part of the nominal load because shock forces can no longer occur. For this reason it is possible within the scope of the invention so to design the winch drive and particularly the torque-limiting coupling that the rope-pulling force will not exceed an upper limit obtained by a multiplication of the force that is due to the rated load by a predetermined safety factor, which preferably amounts to about 1.5. The crane structure will not be subjected to stronger forces because such stronger forces when exerted on the rope will cause the winch drive or the torquelimiting coupling to slip so that the hoisting rope will be pulled in the required length from the hoisting rope winch.

Within the scope of the invention the control means preferably exert on the hoisting rope by means of the winch drive or the torque-limiting coupling an initial rope-pulling force which corresponds to a predetermined fractional part of the rated load, preferably about 5% of the nominal load, and subsequently effect a continuous increase of the rope-pulling force to the value which corresponds to the rated load or is sufficient to hoist the rated load. In that case the hoisting rope will initially be subjected to a relatively weak pulling force until all slackness of the rope has been taken up by the winch, so that a rope slackness will be avoided, and the condition thus obtained will positively and automatically cause a switch to generate a trigger signal which initiates a continuous increase of the rope-pulling force until the load has been lifted from its support.

Within the scope of the invention the circuit may be so designed that the time at which the trigger signal for initiating the increase of the rope-pulling force is generated is selected by the crane operator, provided that the rope has previously been pretensioned.

Within the scope of the invention the rope winch or the rope winch drive may be provided with a torque reaction arm, which in response to the increase of the rope-pulling force to a predetermined value, which is lower than the force corresponding to the rated load, actuates a switch or a valve which when thus actuated positively effects an increase of the driving torque of the winch until the maximum rope-pulling force is exerted. The provision of such torque reaction member will provide an additional safety that the rope-pulling force will not decrease after the load has been lifted from its support. The switch or the valve are suitably actuated by the torque reaction arm when the rope-pulling force exerted on the hoisting rope has increased to the predetermined initial value.

If the winch is driven directly by a motor that motor suitably consists of a rotary hydraulic motor which has an output torque that depends on a controllable fluid pressure.

The torque-limiting coupling suitably consists of a multiple-disc coupling, which may be biased by a spring-loaded piston and which is adapted to be supplied with a hydraulic liquid in order to reduce the torque limit.

The invention is applicable to a luffing-jib crane mounted on a drilling platform. The invention is also applicable to cranes having a rigid job and to jibless cranes.

DETAILED DESCRIPTION OF THE PREFERRED EMBODIMENTS

Figure 1:
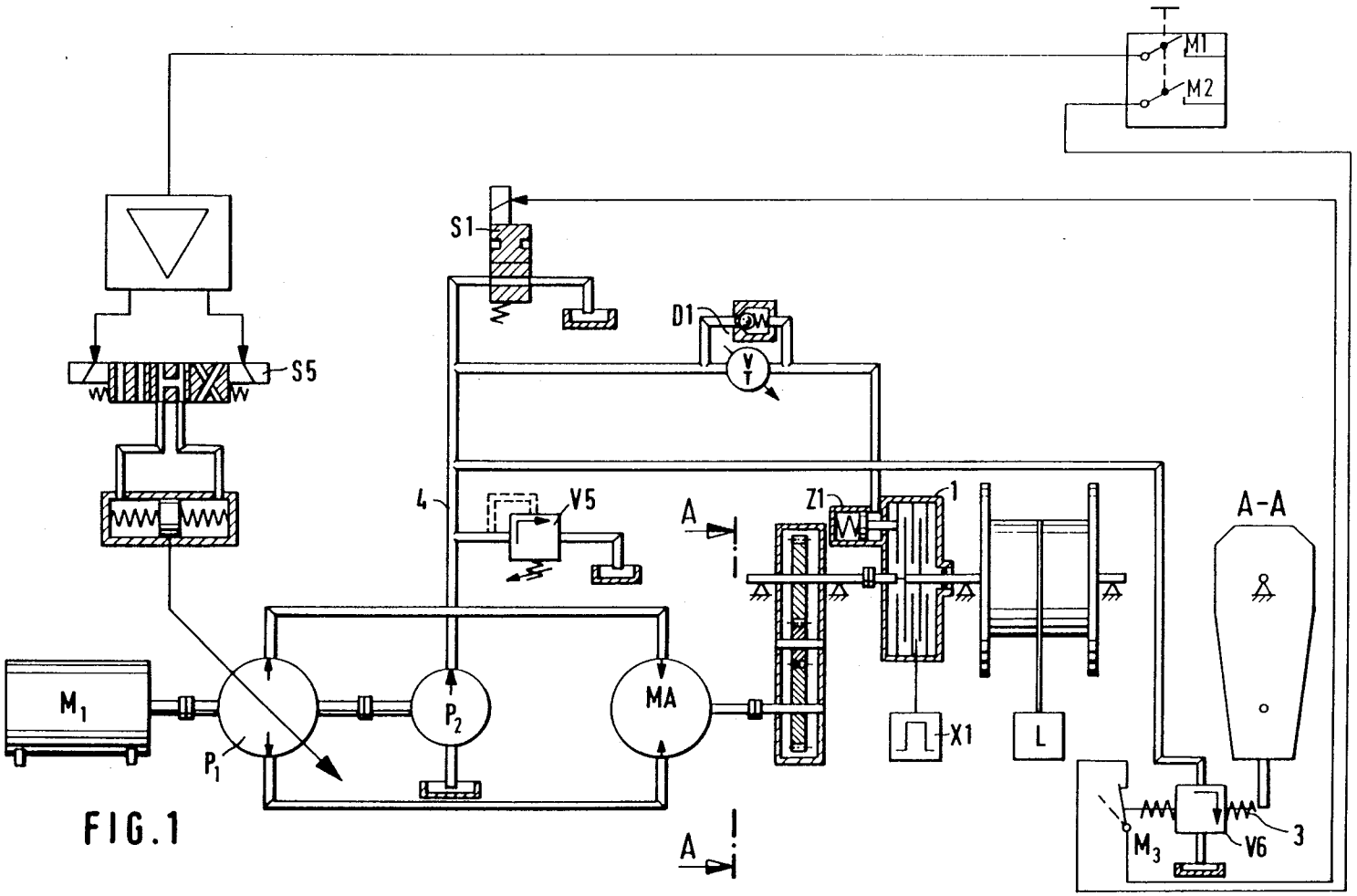
FIG. 1 is a diagrammatic showing of the hoisting mechanism comprising a winch and the associated winch drive and control means.

Illustrative embodiments of the invention will now be described more in detail with reference to the drawing.

The hoisting movement is initiated by an actuation of the control lever, which is illustrated and by its actuation closes the switches M1 and M2. By means of the power stage the proportional valve S5 is energized and the hoisting gear pump is energized to drive the rotary hydraulic motor. When no load L is applied to the hoisting rope, the switch M3 will be closed so that the solenoid valve S1 is energized. A pressure can now build up in the line 4 to the value that is set at the pressure relief valve V5. As is apparent from FIG. 1 a multiple disc coupling 1 is connected between the transmission and the shaft of the winch. The torque limit of the torque-limiting coupling 1 is controlled by the piston rod of the cylinder Z1, which contains a piston that is biased by a compression spring. On the side opposite to the compression spring the piston can be supplied with hydraulic liquid via line 4 so that the spring is compressed and the multiple disc coupling is disengaged by the action of the pressure in the hydraulic line 4.

The pressure relief valve V5 is set to effect a pressure relief at a pressure which determines for the torque-limiting coupling a torque limit corresponding to about 5% of the rated rope-pulling force.

The transmission is rotatably mounted on the shaft and is supported by the spring 3, which is designed to actuate the valve V6 and to cause the switch M3 to open when the rope-pulling force has increased to an initial value amounting to about 5% of the rated rope-pulling force. When that initial value has been reached, the solenoid valve S1 will be deenergized and the valve V6 will effect a pressure relief in the pressure line 4.

The hydraulic pressure in the cylinder Z1 is then gradually relieved through the nozzle D1. The time until a complete pressure relief has been effected is controlled by the nozzle D1 and usually amounts to about 1 second or more. Owing to the slow pressure drop, the torque limit of the coupling rises continuously to the maximum torque limit, which is determined by the adjustable spring in the cylinder Z1.

That control sequence ensures that the multiple disc coupling will be disengaged and will subsequently be gradually re-engaged for each hoisting operation. A redundant control ensures that the coupling will not be disengaged when the load is hanging on the rope.

Figure 2:
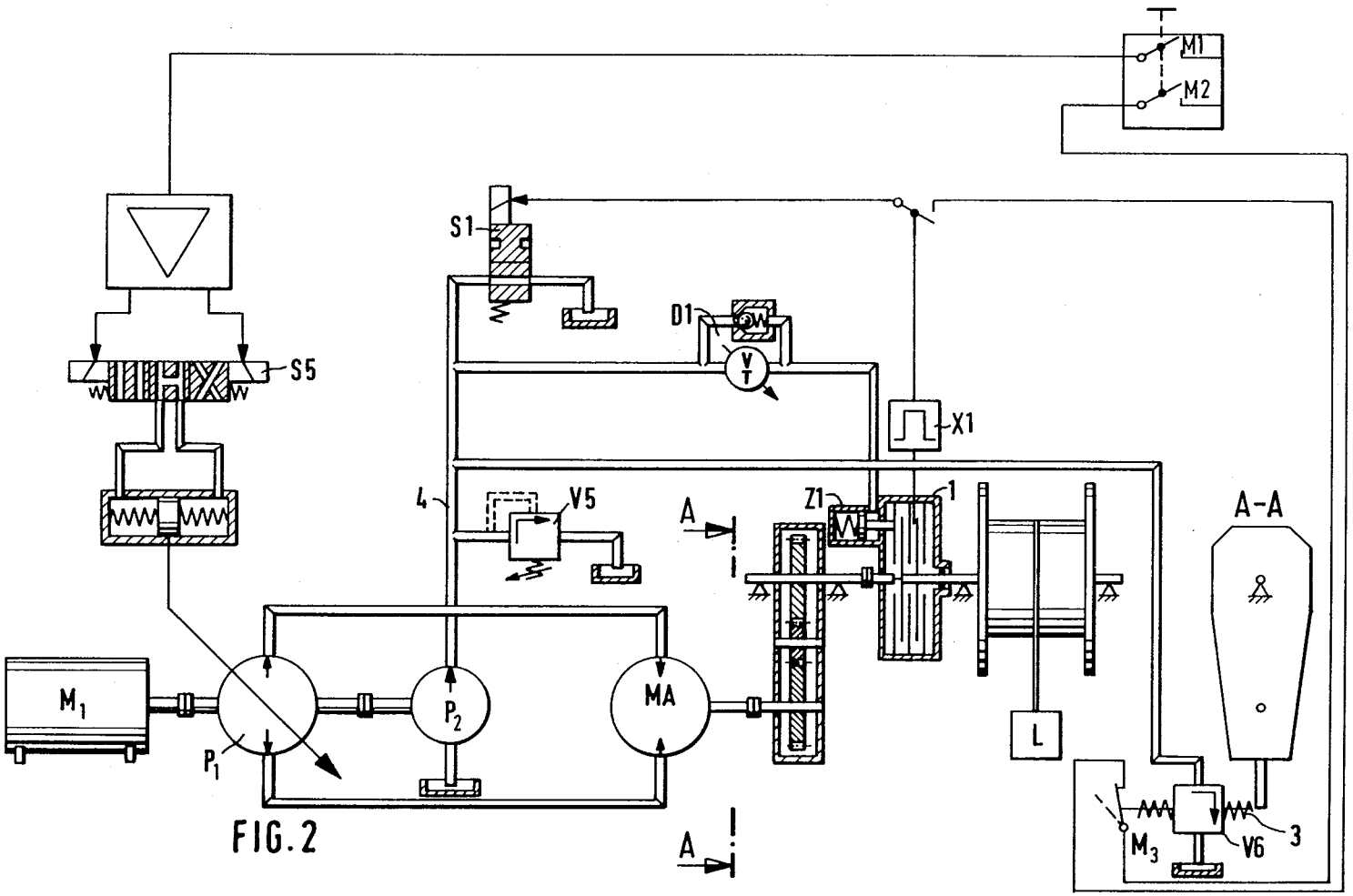
FIG. 2 is a representative that is similar to FIG. 1 and shows in addition an incremental sensor for deenergizing the solenoid S1 as soon as the coupling slips.

For a more sophisticated control, an incremental sensor X1 may be provided, which is shown in FIG. 2 and which will de-energize the solenoid valve S1 as soon as the coupling slips. In response to said de-energization, the above-described operation to re-engage the coupling will be initiated. In that case the coupling will slip when any rope slackness has been taken up by the winch and the rope-pulling force will be continuously increased thereafter.

Further improvements can be effected in that the pressure relief of the cylinder Z1 is not primarily effected through the nozzle D1 but is electronically controlled and the nozzle D1 serves for a redundant control.

A monitoring electric logic may be incorporated, which monitors all systems and in case of a malfunction indicates the location of the defect.

It will be understood that the winch drive used in the illustrated embodiment can be replaced by a different drive.

Figure 3:
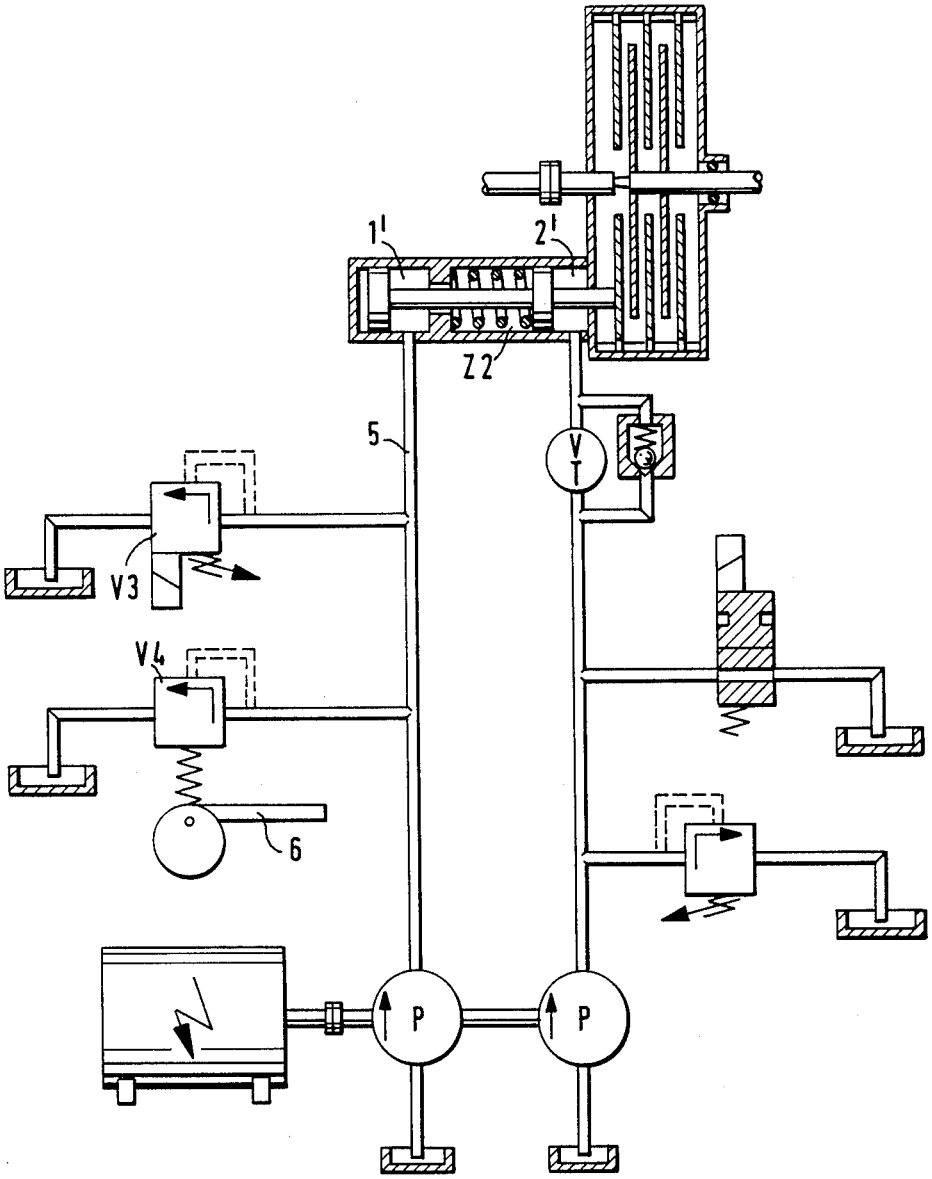
FIG. 3 is a representation which is similar to FIGS. 1 and 2 but shows a different hydraulic cylinder for pressurizing the coupling.

The torque limit and the rope-pulling force depending on said torque limit are so adjusted by means of the spring in the cylinder Z1 that the maximum ropepulling force will not exceed, e.g., 1.5 times the rated load. As a result, an overloading of the crane will be effectively prevented. If the permissible load which can be hoisted by the crane depends on a variable jib radius, the torque limit and the maximum rope-pulling force can be changed in that the chamber 1 of the cylinder Z2 is supplied with hydraulic fluid as is shown in FIG. 3. The cylinder Z1 in FIGS. 1 and 2 is replaced by the cylinder Z2, which is shown in FIG. 3 and has a chamber 1 to which hydraulic pressure is applied.

The resulting pressure in the pressure line 5 is adjusted by the solenoid valve V3 and/or by a mechanically adjustable pressure relief valve V4. The valve V4 can be mechanically adjusted by means of the lever 6, which, e.g., in luffing-jib cranes can be directly actuated by the jib.

I claim:

1. A crane comprising a hoisting mechanism, which comprises a hoisting rope and a hoisting rope winch, winch drive means for the to wind the hoisting rope thereon and a torque-limiting coupling connected between said winch drive means and said winch, control means for said coupling to exert a rope-pulling force on the hoisting rope to increase the rope-pulling force in a period of time in excess of about one second to a value which is sufficient to hoist the load, said winch being rotated in a rope payout being rotated in a rope payout direction by opposing rope-pulling forces which tend to pull the hoisting rope from the winch and which exceed the instantaneous rope-pulling force exerted on the hoisting rope.

2. A crane according to claim 1, characterized in that control means for the torque-limiting coupling limits the rope-pulling force to a value which is obtained by a multiplication of the rated load by a predetermined factor of safety, which amounts to about 1.5.

3. A crane according to claim 1, characterized in that the control means for the torque-limiting coupling initially subjects the hoisting rope to an initial rope-pulling force which amounts to a predetermined fractional part, about 5%, of the rated load, and subsequently gradually increase the rope-pulling force to a value which corresponds to the rated load and is sufficient to hoist the load.

4. A crane according to claim 1, characterized in that the rope winch drive means is provided with a torque reaction arm, which in response to the increase of the rope-pulling force to a predetermined value, which is lower than the force corresponding to the rated load, actuates said control means to positively effect an increase of the driving torque of the winch until the maximum rope-pulling force is exerted.

5. A crane according to claim 4, characterized in that the said control means is actuated by the arm when the rope-pulling force has been increased to the predetermined initial value.

6. A crane according to claim 1, characterized in that the torque-limiting coupling consists of a multiple disc coupling.

7. A crane according to claim 6, characterized in that the control means for the multiple disc coupling includes a spring-loaded piston and hydraulic means to vary the force exerted by the spring-loaded piston to vary the torque output to the winch.

8. A crane comprising a winch having a hoisting rope mounted thereon with the winch including a rotatable drum capable of being rotated in one direction to wind the rope thereon and rotated in the opposite direction to payout the rope for supporting a load, lifting a load and lowering a load, drive means for said winch, said drive means including means progressively increasing the pulling force exerted on the hoisting rope over a predetermined short time span to support and lift the load with opposing forces which tend to pull the hoisting rope from the winch exceeding the insantaneous rope pulling force exerted on the hoisting rope by the winch.

9. A crane according to claim 8 wherein said drive means is connected to the winch through a hydraulically controlled multi-disc coupling and a transmission with the multi-disc coupling and transmission forming the means for progressively increasing the pulling force exerted on the hoisting rope.

10. A crane according to claim 8 characterized in that the rope pulling force exerted on the hoisting rope is increased in steps.

11. A crane according to claim 8 characterized in that the rope pulling force exerted on the hoisting rope is increased continuously.

* * * * *